US006479226B2

(12) United States Patent
Heki

(10) Patent No.: US 6,479,226 B2
(45) Date of Patent: Nov. 12, 2002

(54) SILVER HALIDE COLOR PHOTOGRAPHIC LIGHT SENSITIVE MATERIAL

(75) Inventor: Katsuhiko Heki, Hino (JP)

(73) Assignee: Konica Corporation (JP)

( * ) Notice: Subject to any disclaimer, the term of this patent is extended or adjusted under 35 U.S.C. 154(b) by 7 days.

(21) Appl. No.: 09/838,626

(22) Filed: Apr. 19, 2001

(65) Prior Publication Data

US 2001/0055735 A1 Dec. 27, 2001

(30) Foreign Application Priority Data

Apr. 27, 2000 (JP) ..... 2000-127581

(51) Int. Cl.[7] ..... G03C 1/46

(52) U.S. Cl. ..... 430/506; 430/570; 430/572; 430/576; 430/581; 430/585; 430/588

(58) Field of Search ..... 430/502, 503, 430/570, 572, 576, 581, 585, 506, 588

(56) References Cited

U.S. PATENT DOCUMENTS 3,713,835 A * 1/1973 Sato et al. ..... 430/588
3,718,475 A * 2/1973 Shiba et al. ..... 430/570
3,765,899 A * 10/1973 Sato et al. ..... 430/588
4,047,964 A * 9/1977 Hinata et al. ..... 430/570
4,172,730 A * 10/1979 Hinata et al. ..... 430/588
5,340,711 A * 8/1994 Kim ..... 430/588
5,591,570 A * 1/1997 Takiguchi et al. ..... 430/570
6,296,994 B1 * 10/2001 Sowinski et al. ..... 430/506

* cited by examiner

*Primary Examiner*—Geraldine Letscher
(74) *Attorney, Agent, or Firm*—Bierman, Muserlian and Lucas

(57) ABSTRACT

A silver halide color photographic light sensitive material is disclosed, comprising a support having on one side of the support at least two red-sensitive layers, at least two green-sensitive layers, at least two blue-sensitive layer and a light-insensitive layer, wherein at least one of the green-sensitive layers contains a green-sensitive silver halide emulsion exhibiting a sensitivity maximum at a wavelength of 525 to 540 nm and a sensitivity maximum at a wavelength of 550 to 565 nm.

14 Claims, 1 Drawing Sheet

SILVER HALIDE COLOR PHOTOGRAPHIC LIGHT SENSITIVE MATERIAL

FIELD OF THE INVENTION

The present invention relates to silver halide color photographic light sensitive materials and in particular to silver halide color photographic materials exhibiting enhanced sensitivity and superior color reproduction, specifically, enhanced color reproduction in picture-taking under fluorescent lamps.

BACKGROUND OF THE INVENTION

Factors affecting image representation of silver halide color photographic light sensitive materials include, for example, color reproduction, graininess, sharpness and contrast. Of these, color reproduction is an importance factor. There have been a number of proposals regarding color reproduction. Cited as a factor affecting color reproduction are spectral sensitivity distribution and interimage effect (hereinafter, also denoted as IIE).

In general, when faithful color reproduction is intended in control of spectral sensitivity distribution, shifting the sensitivity of a red-sensitive layer to the shorter wavelength side is of importance in terms of access to human luminous efficacy, as described in JP-B No. 49-6207 (the term, JP-B refers to published Japanese Patent) and JP-A No. 53-20926 and 59-131937 (hereinafter, the term, JP-A refers to unexamined published Japanese Patent Application).

There have been also proposed techniques for enhancing color reproduction which are directed to the difference between spectral sensitivity distribution of the cones of the human eye and that of color photographic films.

In the spectral sensitivity distribution of color photographic films, the blue-sensitive layer has its sensitivity maximum at the longer wavelengths, and the green-sensitive layer having its sensitivity maximum at a slightly longer wavelength and the red-sensitive layer having its sensitivity maximum at much longer wavelengths, compared to the spectral sensitivity distribution of the human eye. The red cone of the human eye has a region containing a portion exhibiting negative sensitivity at wavelengths in the vicinity of 500 nm.

In order to match the spectral sensitivity distribution of color photographic films to that of the human eye, a so-called donor layer was further provided to control the interimage effect, thereby enhancing more faithful reproduction of intermediate color to some extent (as described in JP-A No. 61-3541). However, the use of such a technique to enhance color reproduction results in reduction in sensitivity. Accordingly, a technique for enhancing color reproduction is desired without causing reduction of sensitivity.

On the other hand, photographing scenes of photographic materials cover various fields and an enhancement of photographic speed enables taking pictures indoors under weak light or night scenes. In indoor picture-taking, the representative light source is fluorescent lamps. Spectral emission distribution of the fluorescent lamp is greatly different from that of sun light or electronic flash light. In cases when indoor picture-taking is conducted under fluorescent lamps using an electronic flash, particular attention should be given thereto. Thus, flash light reaches objects close to the photographer but does not reach distant objects, so that reflected light from the fluorescent lamp is recorded on the film. In cases where an object exposed to flash light and an object exposed to fluorescent lamp light are mixed in a single print sheet and when printed in color fitted to the object close to the photographer, as is well know, the far object not reached by flash light becomes greenish.

SUMMARY OF THE INVENTION

Accordingly, it is an object of the present invention to provide a silver halide color photographic material exhibiting enhanced sensitivity and superior color reproduction, specifically, enhanced color reproduction in picture-taking under fluorescent lamps.

The object of the invention can be accomplished by the following constitution:

1. A silver halide color photographic light sensitive material comprising a support having on one side of the support at least two red-sensitive layers, at least two green-sensitive layers, at least two blue-sensitive layer and a light-insensitive layer, wherein at least one of the green-sensitive layers contains a green-sensitive silver halide emulsion exhibiting a sensitivity maximum at a wavelength of 525 to 540 nm and a sensitivity maximum at a wavelength of 550 to 565 nm;
2. The silver halide color photographic material described in 1 above, wherein the sensitivity maximum at a wavelength of 525 to 540 nm exhibits the largest value of sensitivity;
3. The silver halide color photographic material described in 1 above, wherein the sensitivity maximum at a wavelength of 550 to 565 nm exhibits the largest value of sensitivity;
4. The silver halide color photographic material described in 1 above, wherein the green sensitive silver halide emulsion contains a sensitizing dye (1) and a sensitizing dye (2), the sensitizing dye (1) and sensitizing dye (2) exhibiting a sensitivity maximum at a wavelength of 525 to 550 nm and of 560 to 580 nm, respectively, when forming a J-aggregate;
5. The silver halide color photographic material described in 1 above, wherein the green-sensitive silver halide emulsion contains a compound represented by formula (S-1) or (S-2):

formula (S-1)

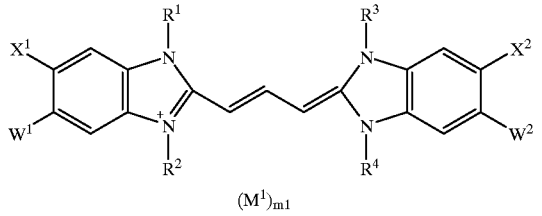

wherein $R^1$ through $R^4$ are each an aliphatic group; $X^1$ and $X^2$ are each a hydrogen atom or a halogen atom; $W^1$ and $W^2$ are each a substituent group containing an oxygen atom; $M^1$ is an ion necessary to counterbalance intramolecular charge; and $m^1$ is the number of the ion(s) necessary to counterbalance the intramolecular charge;

formula (S-2)

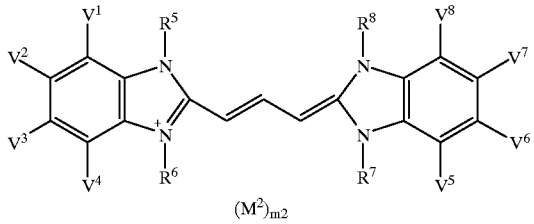

wherein $R^5$ through $R^8$ are each an aliphatic group; $V^1$ through $V^8$ are each a hydrogen atom, a halogen atom or a substituent group, provided that $V^2$ and $V^3$ may combine with each other to form a ring; $M^2$ is an ion necessary to counterbalance intramolecular charge; and $m^2$ is the number of the ion(s) ion necessary to counterbalance the intramolecular charge;

6. The silver halide color photographic material described in 1, wherein at least one of the red-sensitive layers contains a red-sensitive silver halide emulsion exhibiting at least two sensitivity maxima at a wavelength of 500 nm or more, one of the two sensitivity maxima exhibiting the largest value of sensitivity at a wavelength (λmax) of 590 to 630 nm, and the other sensitivity maximum being at a wavelength between λmax and 700 nm;
7. The silver halide color photographic material described in 1 above, wherein at least one of the red-sensitive layers contains a red-sensitive silver halide emulsion exhibiting at least two sensitivity maxima at a wavelength of 500 nm or more, one of the two sensitivity maxima exhibiting the largest value of sensitivity at a wavelength (λmax) of 615 to 640 nm, and the other sensitivity maximum being at a wavelength between 590 nm and λmax;
8. The silver halide color photographic material described in 1, wherein at least one of the blue-sensitive layers contains a blue-sensitive silver halide emulsion exhibiting at least two sensitivity maxima, one of the two sensitivity maxima exhibiting the largest value of sensitivity at a wavelength (λmax) of 450 to 480 nm, and the other sensitivity maximum being at a wavelength between 410 nm and λmax;
9. The silver halide color photographic material described in 1, wherein at least one of the red-sensitive layers exhibits a center-of-gravity wavelength ($\lambda_R$) of a spectral sensitivity distribution at 600 to 680 nm, at least one of the green-sensitive layers exhibiting a center-of-gravity wavelength ($\lambda_G$) of a spectral sensitivity distribution at 500 to 580 nm, and at least one of the blue-sensitive layers exhibiting a center-of-gravity wavelength ($\lambda_B$) of a spectral sensitivity distribution at 400 to 480 nm; the red-sensitive exhibiting a center-of-gravity wavelength of a spectral sensitivity distribution at a wavelength ($\lambda_{-R}$) of 500 to 560 nm with respect to the magnitude of an interimage effect given by another light sensitive layer within the region of 500 to 600 nm and meeting the requirement of $\lambda_G-\lambda_{-R}\geqq 10$ nm; the green-sensitive exhibiting a center-of-gravity wavelength of a spectral sensitivity distribution at a wavelength ($\lambda_{-G1}$) of 400 to 460 nm with respect to the magnitude of an interimage effect given by another light sensitive layer within the region of 400 to 500 nm and meeting the requirement of $\lambda_B-\lambda_{-Ga}\geqq 10$ nm; and the green-sensitive exhibiting a center-of-gravity wavelength of a spectral sensitivity distribution at a wavelength ($\lambda_{-G2}$) of 620 to 700 nm with respect to the magnitude of an interimage effect given by another light sensitive layer within the region of 600 to 700 nm and meeting the requirement of $\lambda_R-\lambda_{-G2}\leqq -10$ nm;
10. The silver halide color photographic material described in 1, wherein the green-sensitive silver halide emulsion contains tabular silver halide grains exhibiting an aspect ratio of 8 or more;
11. The silver halide color photographic material described in 1, wherein the green-sensitive silver halide emulsion exhibits a sensitivity maximum at a wavelength of 525 to 535 nm and a sensitivity maximum at a wavelength of 555 to 565 nm;
12. The silver halide color photographic material described in 6, wherein the red-sensitive silver halide emulsion exhibits at least two sensitivity maxima at a wavelength of 500 nm or more, one of the two sensitivity maxima exhibiting the largest value of sensitivity at a wavelength (λmax) of 600 to 630 nm, and the other sensitivity maximum being at a wavelength between λmax and 675 nm;
13. The silver halide color photographic material described in 7, wherein the red-sensitive silver halide emulsion exhibiting at least two sensitivity maxima at a wavelength of 500 nm or more, one of the two sensitivity maxima exhibiting the largest value of sensitivity at a wavelength (λmax) of 625 to 640 nm, and the other sensitivity maximum being at a wavelength between 600 nm and λmax;
14. The silver halide color photographic material described in 8, wherein the blue-sensitive silver halide emulsion exhibits at least two sensitivity maxima, one of the two sensitivity maxima exhibiting the largest value of sensitivity at a wavelength (λmax) of 460 to 475 nm, and the other sensitivity maximum being at a wavelength between 415 nm and λmax.

DETAILED DESCRIPTION OF THE INVENTION

When a silver halide color photographic material used in this invention is exposed to spectral light at intervals of a few nms within the range of 400 to 700 nm, sensitivity at each wavelength is defined as the reciprocal of exposure giving a prescribed density at each wavelength. In this invention, the spectral sensitivity is represented as a function of wavelength.

Figure 1:
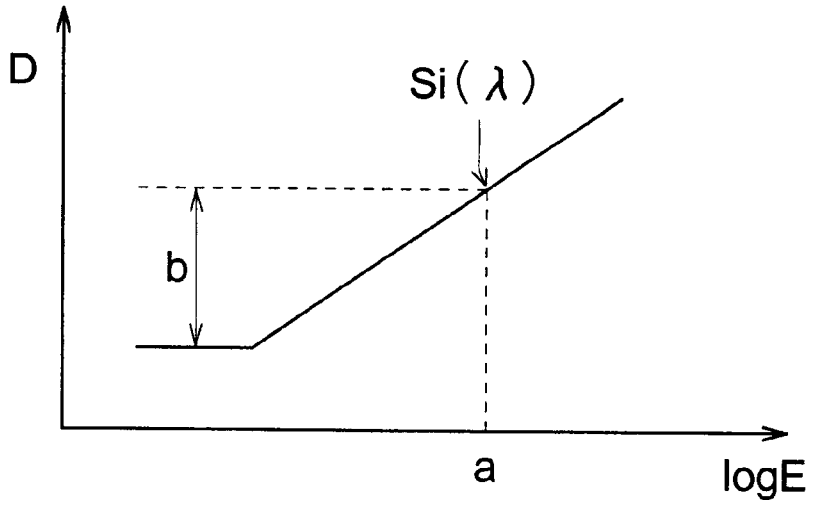
FIG. 1 illustrates a characteristic curve of a color photographic material.

A characteristic curve is obtained by subjecting the silver halide photographic material to exposure to monochromatic light having a wavelength of λ and photographic processing (sensitometry), as shown in FIG. 1, in which the abscissa represents logarithmic exposure (log E) and the ordinate represents density. Sensitivity at a specified wavelength, $S_i(\lambda)$ is represented by a relative value of a reciprocal of exposure "a" giving a density of the minimum density plus "b", as shown in FIG. 1 (i=R, G, or B). In this invention, the value of "b" is defined to be 0.3, though the value of "b" may be within the range of 0.1 to 2.0. In the silver halide color photographic material, the sensitivity of the blue-sensitive layer, $S_B(\lambda)$ can be obtained by measuring the density with blue light. Similarly, sensitivities of the green-sensitive layer and red-sensitive layer, $S_G(\lambda)$ and $S_R(\lambda)$ can be obtained by measuring the density with green light and red light, respectively.

In this invention, the maximum sensitivity refers to the largest value of sensitivity and the maximum sensitivity wavelength refers to the wavelength at which the largest sensitivity is obtained. The maximum sensitivity wavelength of the spectral sensitivity distribution of a silver halide emulsion contained in the green-sensitive layer, for example, is a wavelength at which the emulsion exhibits the largest value of sensitivity $S_G(\lambda)$. One feature of this invention is that in addition to the largest value, the sensitivity distribution further contains one sensitivity maximum, i.e., the emulsion exhibits another sensitivity peak within the spectral sensitivity distribution. In other words, the silver halide emulsion exhibits a spectral sensitivity distribution having two sensitivity maxima, one of the sensitivity maxima exhibiting the largest sensitivity.

In this invention, effects of the invention can be achieved by the silver halide color photographic light sensitive material comprises a support having on one side of the support at least two red-sensitive layers, at least two green-sensitive layers, at least two blue-sensitive layers and a light-insensitive layer, in which in at least one of the green-sensitive layers, the sensitivity wavelength ($\lambda$) of spectral sensitivity distribution of a silver halide emulsion contains a sensitivity maximum in the region of 525 nm$\leqq\lambda\leqq$540 nm and the emulsion further exhibits a sensitivity maximum at the wavelength of 550 nm$\leqq\lambda\leqq$565 nm. Further, in the spectral sensitivity distribution of a silver halide emulsion contained in at least one of the green-sensitive layers, it is preferred that the sensitivity maximum exhibiting the largest sensitivity is within the wavelength region of 525 nm$\leqq\lambda$max$\leqq$540 nm and another sensitivity maximum is within the wavelength region of 550 nm$\leqq\lambda\leqq$565 nm, or the sensitivity maximum exhibiting the largest sensitivity is within the wavelength region of 550 nm$\leqq\lambda$max$\leqq$565 nm and another sensitivity maximum is within the wavelength region of 525 nm$\leqq\lambda\leqq$540 nm. It is further preferred that the sensitivity maximum exhibiting the largest sensitivity is within the wavelength region of 525 nm$\leqq\lambda$max$\leqq$535 nm and another sensitivity maximum is within the wavelength region of 555 nm$\leqq\lambda\leqq$565 nm, or the sensitivity maximum exhibiting the largest sensitivity is within the wavelength region of 555 nm$\leqq\lambda$max$\leqq$565 nm and another sensitivity maximum is within the wavelength region of 525 nm$\leqq\lambda\leqq$535 nm.

In order that, in addition to the maximum sensitivity (i.e., the sensitivity maximum exhibiting the largest sensitivity), the emulsion exhibits one more sensitivity maximum, it is preferred that at least two sensitizing dyes which are different in absorption wavelength are used and a part or all of one of the sensitizing dyes is added to the emulsion at a time different from addition of the other sensitizing dye. When adsorbed to the silver halide grains in an emulsion, many, though by no means all, sensitizing dyes form reversible oriented aggregates of molecules, of which one type, the "J-aggregate" is commonly known in the art. In one of preferred embodiments of this invention, at least a green sensitive silver halide emulsion of the green-sensitive layer contains at least two sensitizing dyes, in which one of the sensitizing dyes exhibits a sensitivity maximum at a wavelength of 525 to 550 nm when forming a J-aggregate and the other sensitizing dye exhibiting a sensitivity maximum at a wavelength pf 560 to 580 nm when forming a J-aggregate. Specifically, to achieve spectral sensitivity distribution having a double peak structure in the orthochromatic region (i.e., green-sensitive region) and exhibiting not only a maximum spectral sensitivity but also another spectral sensitivity maximum, a compound represented by the following formula (S-1) or (S-2) is preferably used as at least one of sensitizing dyes:

formula (S-1)

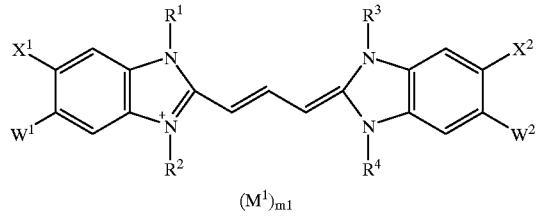

wherein $R^1$ through $R^4$ are each an aliphatic group; $X^1$ and $X^2$ are each a hydrogen atom or halogen atom; $W^1$ and $W^2$ are each a substituent group containing an oxygen atom; $M^1$ is an ion necessary to counterbalance intramolecular charge; and m1 is a number necessary therefor;

formula (S-2)

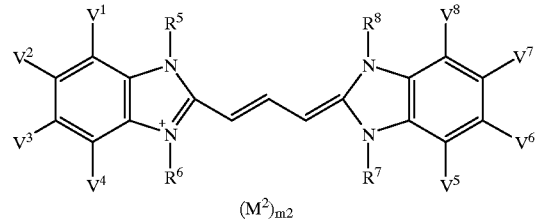

wherein $R^5$ through $R^8$ are each an aliphatic group; $V^1$ through $V^8$ are each a hydrogen atom, a halogen atom or a substituent group, provided that $V^2$ and $V^3$ may combine with each other to form a ring; $M^2$ is an ion necessary to counterbalance intramolecular charge; and m2 is a number necessary therefor.

In formulas (S-1) and (S-2), the aliphatic group represented by $R^1$ through $R^8$ include an straight chain or branched alkyl group having 1 to 10 carbon atoms (e.g., methyl, ethyl, propyl, butyl, pentyl, iso-pentyl, 2-ethylhexyl, octyl, decyl, etc.), an alkenyl group having 3 to 10 carbon atoms (e.g., 2-propenyl, 3-butenyl, 1-methyl-3-propenyl, 3-pentenyl, 1-methyl-3-butenyl, 4-hexenyl, etc.), and an aralkyl group having 7 to 10 carbon atoms (e.g., benzyl, phenethyl, etc.). These groups may be substituted by a substituent group such as a halogen atom, an alkoxy group (e.g., methoxy, ethoxy, etc.), an aryloxy group (e.g., phenoxy, p-tolyloxy, etc.), cyano group, a carbamoyl group (e.g., carbamoyl, N-methylcarbamoyl), N,N-tetramethylenecarbamoyl, etc.), a sulfamoyl group (e.g., sulfamoyl, N,N-3-oxapentamethyleneaminosilfonyl, etc.), a haloalkyl group (e.g., 2,2,2-trifluoroethyl, 2,2,3,3-tetrafluoropropyl, etc.), an alkylsulfonyl group (e.g., methanesulfonyl, ethanesulfonyl, etc.), an alkoxycarbonyl group (ethoxycarbonyl, butoxycarbonyl), an aryl group (e.g., phenyl, carboxyphenyl, etc.), an acyl group (e.g., acetyl, benzoyl, etc.), an acylamino group (e.g., acetylamino, benzoylamino, etc.), or a sulfonamido group (e.g., methanesulfonamido, butanesulfoneamido, etc.); and preferably by an aqueous solubility-promoting group, such as a sulfo group, carboxy group, phosphono group, sulfate group, hydroxy group, sulfino group, sulfonylamino group (e.g., methanesulfonylaminocarbonyl, ethanesulfonylaminocarbonyl, etc.), acylaminosulfonyl group (e.g., acetoamidosulfonyl, methoxyacetoamidosulfonyl, etc.), acylaminocarbonyl group (e.g., acetoamidocarbonyl, methoxyacetoamidocarbonyl, etc.), and sulfinylaminocarbonyl group (e.g., methanesulfinylaminocarbonyl, ethanesulfinylaminocarbonyl, etc.).

Examples of the aliphatic group substituted by the aqueous solubility-promoting group include carboxy methyl, carboxymethyl, sulfoethyl, 3-sulfopropyl, 4-sulfobutyl, 5-sulfopentyl, 3-sulfobutyl, 3-sulfopentyl, 6-sulfo-3-oxahexyl, ω-sulfopropoxycarbonylmethyl, ω-sulfopropylaminocarbonyl, N-methanesulfonylcarbamoylmethyl, 3-sulfobutyl, 3-phosphonopropyl, hydroxyethyl, N-methanesulfonylcarbamoylmethyl, 4-phospho-3-butenyl, 4-carboxybutyl, 2-carboxy-2-propenyl, o-sulfobenzyl, p-sulfophenethyl, and p-carboxybnzyl.

In formula (S-1), $X^1$ and $X^2$ represent a halogen atom (e.g., fluorine, chlorine, bromine and iodine atoms) or a hydrogen atom. $W^1$ and $W^2$ represent a substituent group containing an oxygen atom, including, for example, an alkoxy group (e.g., methoxy, ethoxy, etc.), carboalkoxy group (e.g., carbomethoxy, carboethoxy, etc.), carbamoyl group (e.g., methylcarbamoyl, ethylcarbamoyl, etc.), acyloxy group (e.g., acetoxy, etc.), acyl group (e.g., acetyl, propionyl, trifluoroacetyl, etc.), sulfonyl group (e.g., methanesulfonyl, trifluoromethylsulfonyl, benzenesulfonyl, etc.), hydroxy-substituted alkyl group (e.g., hydroxymethyl, etc.), and methoxymethyl. The oxygen containing substituent groups are not limited to the above-described groups, but may be a group containing the above-described groups.

In formula (S-2), the substituent group represented by $V^1$ through $V^8$ include an alkyl group (e.g., methyl, ethyl, butyl, isobutyl, etc.), an alkenyl group (e.g., 2-propenyl, 1-propenyl, 1-methyl-3-butenyl, etc.), an aralkyl group (e.g., benzyl, phenethyl, etc.), a sulfide group (e.g., methylthio, ethylthio, phenylthio, etc.), a halogen atom, an aryl group (e.g., phenyl, m-chlorophenyl, p-tolyl, naphthyl, etc.), a heterocyclic group (e.g., pyridyl, pyrrolyl, 2-methylpyrrolyl, indolyl, imidazolyl, furyl, thiazolyl, pyrimidyl, etc.), an acyl group (e.g., acetyl, benzoyl, etc.), an acyloxy group (e.g., acetyloxy, benzoyloxy, etc.), cyano group, trifluoromethyl group, a sulfonyl group (e.g., methanesulfonyl, benzenesulfonyl, etc.), a carbamoyl group (e.g., carbamoyl, N,N-dimethylcarbamoyl, morpholinocarbamoyl, etc.), a sulfamoyl group (e.g., sulfamoyl, N-phenylsulfamoyl, morpholinosulfonyl, etc.), an acylamino group (e.g., acetylamino, benzoylamino, etc.), a sulfonylamino group (e.g., methanesulfonylamino, benzenesulfonylamino, etc.), and an alkoxycarbonyl group (e.g., methoxycarbonyl, ethoxycarbonyl, trifluoromethoxycarbonyl, etc.). These substituent groups may be further substituted by the substituent groups described above.

Ions represented by $M^1$ and $M^2$ include anions such as chloride ion, bromide ion, iodide ion, thiocyanate ion, sulfate ion, perchlorate ion, p-toluenesulfonate ion and ethylsulfate ion; and cations such as lithium ion, sodium ion, potassium ion, magnesium ion, triethylammonium ion and diazabicycloundecenium ion. In cases where an intramolecular salt is formed and charge is neutralized, m1 and m2 are zero.

Exemplary examples of the compounds represented by formula (S-1) and (S-2) are shown below, but are by no means limited to these.

S-1-1

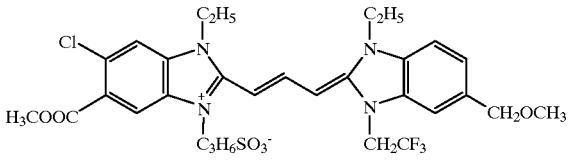

S-1-2

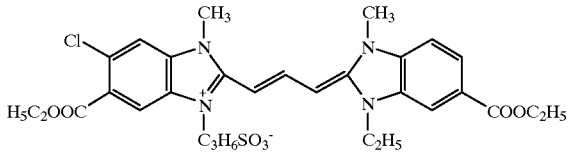

S-1-3

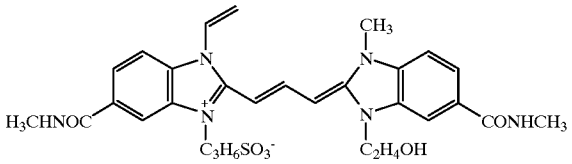

S-1-4

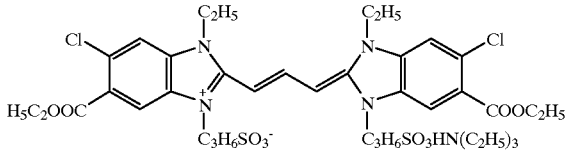

S-1-5

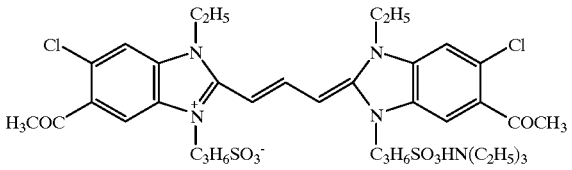

S-1-6

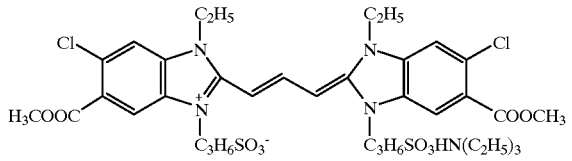

S-1-7

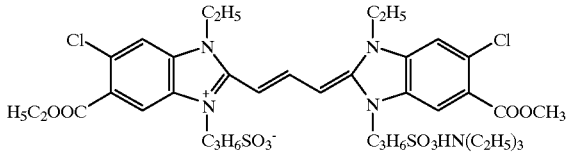

S-1-8

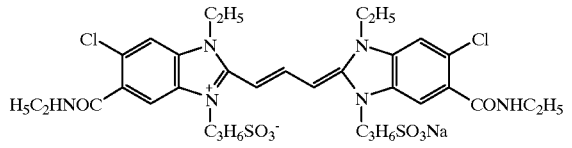

-continued
S-1-9
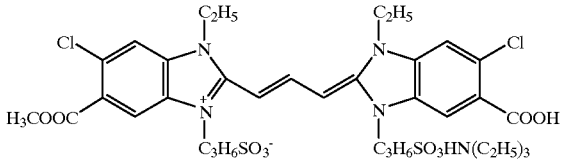
S-1-10
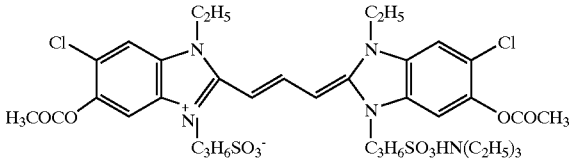
S-1-11
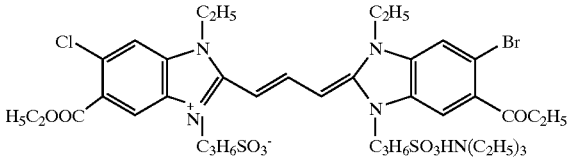
S-1-12
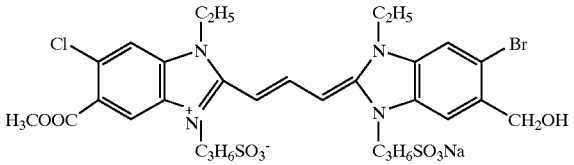
S-1-13
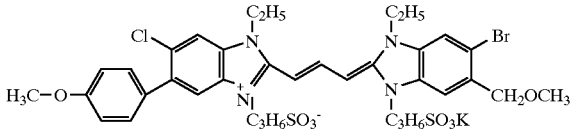
S-1-14
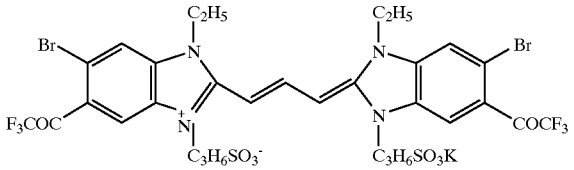
S-1-15
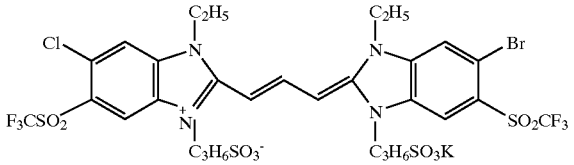
S-1-16
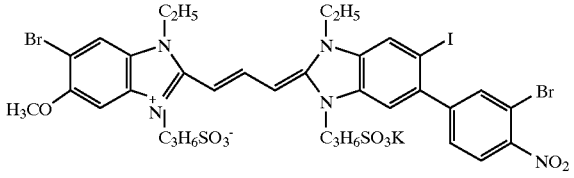
-continued
S-1-17
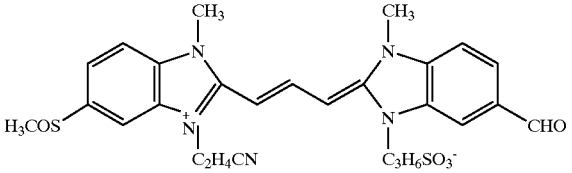
S-1-18
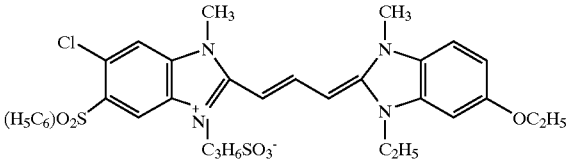
S-2-1
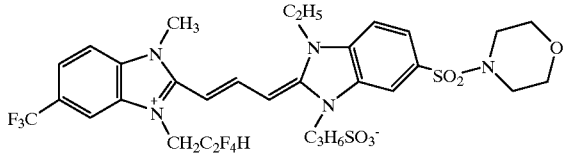
S-2-2
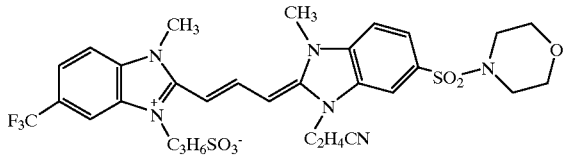
S-2-3
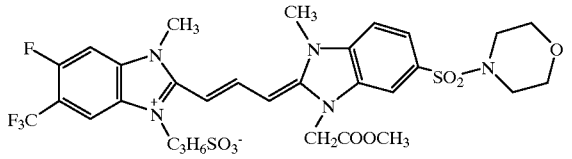
S-2-4
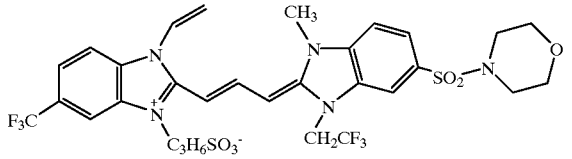
S-2-5
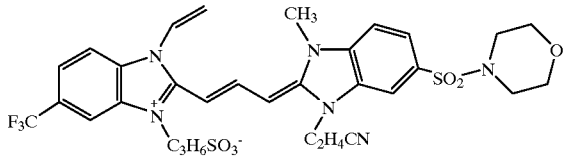
S-2-6
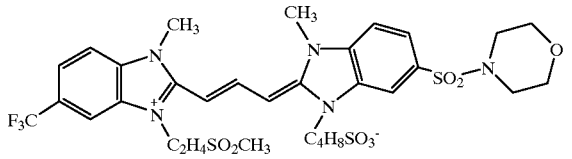

-continued

S-2-7

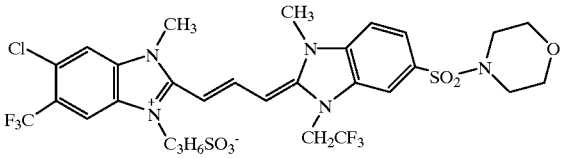

S-2-8

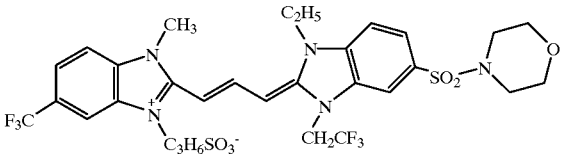

S-2-9

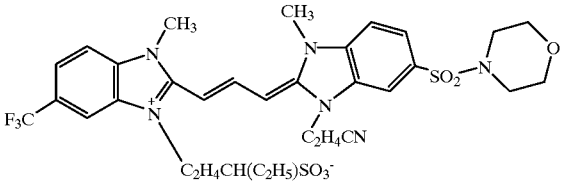

S-2-10

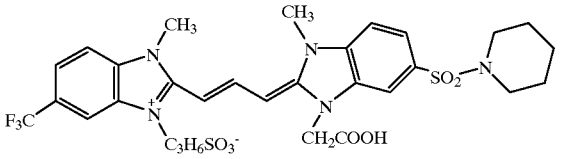

S-2-11

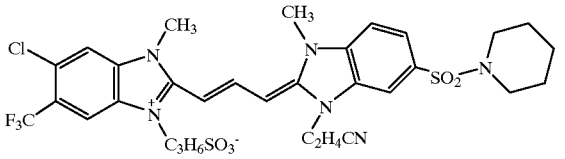

S-2-12

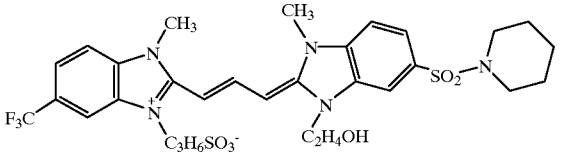

S-2-13

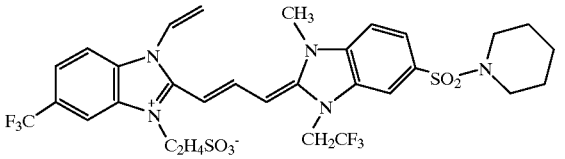

S-2-14

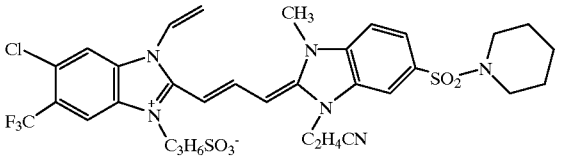

-continued

S-2-15

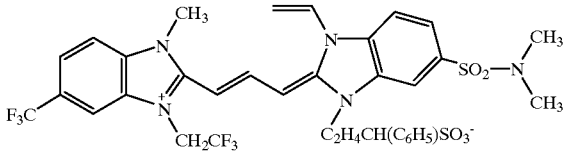

S-2-16

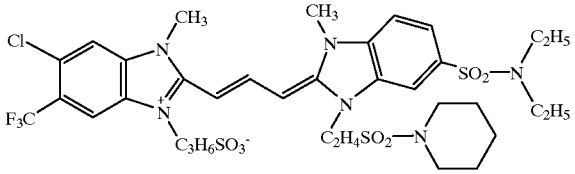

S-2-17

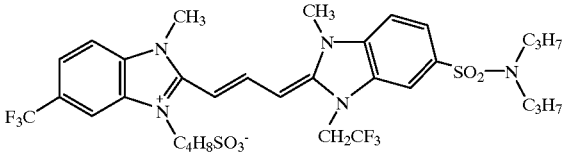

S-2-18

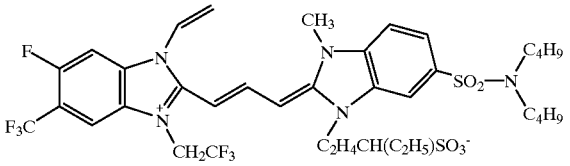

The structure described above simply indicates one state of the resonance structure and therefore, even if a positive charge is put into another symmetrical nitrogen containing ring, it should be construed as being identical.

Benzimidazolocarbocyanine dyes represented by formulas (S-1) and (S-2) can be readily synthesized by referring to the commonly known methods, for example, as described in F. M. Hamer, "Cyanine Dyes and Related Compounds" (Hojn Wirey & Sons, New York, London 1964, Inter-Science Publisher), and D. M. Sturmer "Heterocyclic Compounds, Special Topics in Heterocyclic Chemistry" (John Wirey & Sons, New York, London 1977).

The benzimidazolocarbocyanine dyes can be incorporated into a silver halide emulsion according to methods known in the art. Examples thereof include incorporation through a protonated solution, described in JP-A No. 50-80826 and 50-80827, incorporation by dispersion with a surfactant described in U.S. Pat. No. 3,822,135 and JP-A 50-11419, incorporation through dispersion in a hydrophilic substrate, described in U.S. Pat. Nos. 3,676,147, 3,469,987, 4,247,627, and JP-A 51-59942, 53-16624, 53-102732, 53-102733, and 53-137131, incorporation in a solid solution form, described in East German Patent No. 143,327, Research disclosure No. 21,802, JP-B No. 50-40659 and JP-A 59-148053, and incorporation through solution in water-soluble solvents (e.g., low boiling solvents such as water, methanol, ethanol, propyl alcohol, acetone, fluorinated alcohols and high boiling solvents such as dimethylformamide, methyl cellosolve and phenyl cellosolve) Suitable method is selected from these methods and employed singly or in combination. Incorporation in the form of a solid particle dispersion is also preferred, as described in JP-A 52-92716, 55-155350, 55-155351, 63-197943 and 3-182743, and International Patent WO88/04794. The benzimidazolocarbocyanine dye can be incorporated at any stage during the emulsion manufacturing process of from physical ripening of a silver halide emulsion to coating after completion of chemical ripening, and preferably at the stage of from physical ripening to completion of chemical ripening. It is preferred to incorporate the dye used in this invention during physical ripening, or prior to or immediately after addition of a chemical sensitizer, leading to enhanced spectral sensitivity. The amount of the dye to be added is variable, depending on conditions using an emulsion or the kind of the emulsion. It is preferred to add in an amount forming a mono-molecular layer coverage of 40 to 90%, and more preferably 50 to 80% on the surface of silver halide grains of the emulsion. The monomolecular layer coverage is determined as a relative value, based on the saturated adsorption amount at 50° C. being 100%. The optimal amount, depending on total surface area of silver halide grains is preferably less than 600 mg per mol of silver halide.

The dyes described above may be used in combination with other sensitizing dyes. Dyes used in combination include cyanine dyes, merocyanine dyes, complex cyanine dyes, complex merocyanine dyes, holopolar cyanine dyes, hemi-cyanine dyes, styryl dyes and hemi-oxonol dyes. Of these dyes, cyanine dyes, merocyanine dyes and complex merocyanine dyes are preferred. Commonly employed nuclei are applicable to these dyes. There may be incorporated dyes having no spectrally sensitizing capability or materials substantially having no absorption of visible light, which exhibit supersensitization.

In silver halide color photographic material, the spectral sensitivity distribution of the green-sensitive layer comprises, in addition to a sensitivity maximum exhibiting the largest sensitivity, another sensitivity maximum. In addition thereto, it is preferred that at least one silver halide emulsion contained in the red-sensitive layer has a spectral sensitivity distribution at a wavelength of 500 nm or more, which comprises a sensitivity maximum exhibiting the largest sensitivity at a wavelength of 590 to 630 nm (i.e., 590 nm$\leqq\lambda$max$\leqq$630 nm) and further comprises another sensitivity maximum at a longer wavelength of the $\lambda$max to 700 nm (i.e., $\lambda$max$<\lambda\leqq$700 nm). In this case, it is more preferred that a sensitivity maximum exhibiting the largest sensitivity is at a wavelength of 600 to 630 nm (i.e., 600 nm$\leqq\lambda$max$\leqq$630 nm) and another sensitivity maximum is at a longer wavelength is of the $\lambda$max to 675 nm (i.e., $\lambda$max$<\lambda\leqq$675 nm). In cases where at least a silver halide emulsion contained in the red-sensitive layer has a sensitivity maximum exhibiting the largest sensitivity and further having a sensitivity maximum at a longer wavelength, the sensitivity maximum at the longer wavelength is preferable at a wavelength longer by at least 10 nm (and more preferably at least 20 nm) than the $\lambda$max. The above-described spectral sensitivity distribution of the silver halide emulsion contained in the red-sensitive layer can be achieved by various methods. For example, it is preferred that at least two sensitizing dyes which are different in absorption wavelength are used and a part or all of one of the sensitizing dyes is added to the emulsion at a time different from that of the other sensitizing dye.

In the silver halide color photographic material, the spectral sensitivity distribution of the green-sensitive layer comprises, in addition to a sensitivity maximum exhibiting the largest sensitivity, another sensitivity maximum. In addition thereto, it is also preferred that at least one silver halide emulsion contained in the red-sensitive layer has a spectral sensitivity distribution at the wavelengths of 500 nm or more, which comprises a sensitivity maximum exhibiting the largest sensitivity at a wavelength of 615 to 640 nm (i.e., 615 nm$\leqq\lambda$max$\leqq$640 nm) and further comprises another sensitivity maximum at a shorter wavelength of 590 nm to the $\lambda$max (i.e., 590$\leqq\lambda<\lambda$max). It is more preferred that the sensitivity maximum exhibiting the largest sensitivity is at a wavelength of 625 to 640 nm (i.e., 625 nm$\leqq\lambda$max$\leqq$640 nm) and another sensitivity maximum is at a shorter wavelength of 600 nm to the $\lambda$max (i.e., 600$\leqq\lambda<\lambda$max). In cases where at least a silver halide emulsion contained in the red-sensitive layer has a sensitivity maximum exhibiting the largest sensitivity and further having a sensitivity maximum at a shorter wavelength, the sensitivity maximum at the shorter wavelength is preferable to a wavelength less by at least 10 nm (and more preferably at least 20 nm) than the $\lambda$max.

In cases where at least a silver halide emulsion contained in the green-sensitive layer has a sensitivity maximum exhibiting the largest sensitivity and further having a sensitivity maximum at a longer wavelength, it is preferred that a silver halide emulsion contained in the red-sensitive layer has a sensitivity maximum exhibiting the largest sensitivity and further having a sensitivity maximum at a longer wavelength; and in cases where at least a silver halide emulsion contained in the green-sensitive layer has a sensitivity maximum exhibiting the largest sensitivity and further having a sensitivity maximum at a shorter wavelength, it is also preferred that a silver halide emulsion contained in the red-sensitive layer has a sensitivity maximum exhibiting the largest sensitivity and further having a sensitivity maximum at a shorter wavelength.

The above-described spectral sensitivity distribution of the silver halide emulsion contained in the red-sensitive layer can be achieved by various methods. For example, it is preferred that at least two sensitizing dyes which are different in absorption wavelength are used and a part or all of one of the sensitizing dyes is added to the emulsion at a time different from that of the other sensitizing dye.

In the silver halide color photographic material, the spectral sensitivity distribution of the green-sensitive layer comprises, in addition to a sensitivity maximum exhibiting the largest sensitivity, another sensitivity maximum and the spectral sensitivity distribution of the red-sensitive layer comprises, in addition to a sensitivity maximum exhibiting the largest sensitivity, another sensitivity maximum. In addition thereto, it is preferred that at least one silver halide emulsion contained in the blue-sensitive layer has a spectral sensitivity distribution, which comprises a sensitivity maximum exhibiting the largest sensitivity at a wavelength of 450 nm$\leqq\lambda$max 480 nm (more preferably, 460 nm$\leqq\lambda$max$\leqq$475 nm) and further comprises another sensitivity maximum at a shorter wavelength of 410 nm$\leqq\lambda\leqq\lambda$max (more preferably, 415$\leqq\lambda<\lambda$max) In cases where at least a silver halide emulsion contained in the blue-sensitive layer has a sensitivity maximum exhibiting the largest sensitivity and further having a sensitivity maximum at a shorter wavelength, the sensitivity maximum at the shorter wavelength is preferable to a wavelength less by at least 10 nm (and more preferably at least 20 nm) than the $\lambda$max. The above-described spectral sensitivity distribution of the silver halide emulsion contained in the red-sensitive layer can be achieved by various methods. For example, it is preferred that at least two sensitizing dyes which are different in absorption wavelength are used and a part or all of one of the sensitizing dyes is added to the emulsion at the time different from that of the other sensitizing dye.

Thus, when the spectral sensitivity distribution of each of the color-sensitive layers exhibits double peaks which comprises a sensitivity maximum exhibiting the largest sensitivity and another sensitivity maximum, not only improved fitness to different light sources but also enhanced color reproduction were unexpectedly achieved.

Further, color reproduction can be further enhanced by the combination with an interimage effect (also denoted as IIE).

The interimage effect will be further described. In this invention, the center-of-gravity wavelength of the spectral sensitivity distribution is defined as below, using spectral sensitivity curve $S_i(\lambda)$ defined earlier:

$$\lambda_i=[\int\lambda\cdot S_i(\lambda)d\lambda]/[\int S_i(\lambda)d\lambda]$$

i=R, G, B

In this invention, the center-of-gravity wavelength, $\lambda_{-i}$ (i=R, G, B) of the spectral sensitivity distribution with respect to magnitude in interimage effect given by other layer(s) is defined as follows.

Figure 2:
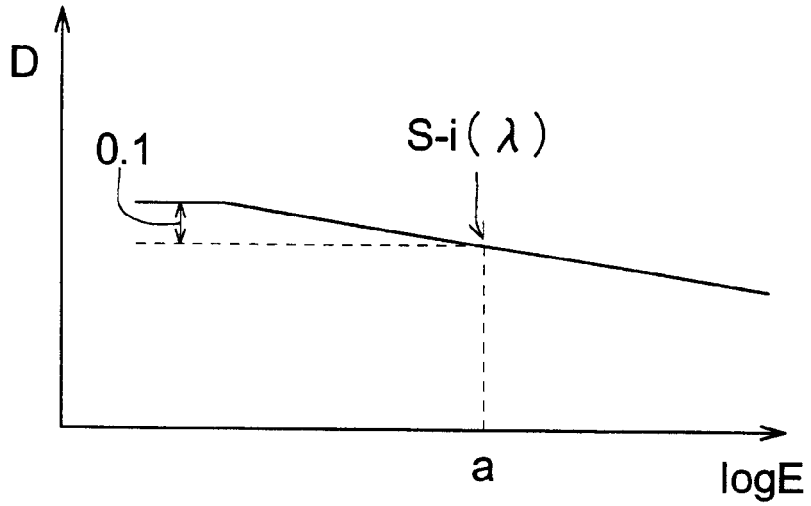
FIG. 2 illustrates a characteristic curve of a reveral color photographic material.

Thus, a specified silver halide light sensitive layer (1) of a color photographic material is overall exposed through an interference filter so that other light sensitive layers are not exposed. Next, when the photographic material is further subjected to spectral exposure and processed, other layer(s) exert a development-inhibiting interimage effect to the overall exposed silver halide light sensitive layer to form a reversal image. Spectral sensitivity distribution $S_{-i}(\lambda)$ as a reversal photographic material is determined from the thus formed reversal image. The $S_{-i}(\lambda)$ at a specific wavelength ($\lambda$) is determined from point "a" in FIG. 2. FIG. 2 shows a characteristic curve obtained when exposed to light of a wavelength of $\lambda$, as a reversal photographic material. This is further represented as a function of a wavelength to give spectral sensitivity distribution $S_{-i}(\lambda)$ as a reversal photographic material.

Using this, the center-of-gravity wavelength, $\lambda_{-i}$ of the wavelength distribution of the magnitude of interimage effect can be determined based on the following equation:

$$\lambda_{-i}=[\int\lambda\cdot S_{-i}(\lambda)d\lambda]/[\int S_{-i}(\lambda)d\lambda]$$

i=R, G, B

With regard to preferred combination of interimage effects in this invention, when the center-of-gravity wavelength of spectral sensitivity distribution ($\lambda_R$) of at least one of the red-sensitive layers is 600 to 680 nm, the center-of-gravity wavelength of spectral sensitivity distribution ($\lambda_G$) of at least one of the green-sensitive layers is 500 to 580 nm and the center-of-gravity wavelength of spectral sensitivity distribution ($\lambda_B$) of at least one of the blue-sensitive layers is 400 to 480 nm, the center-of-gravity wavelength ($\lambda_{-R}$) of the wavelength distribution of magnitude in interimage effect which the red-sensitive layer receives from other layers within the range of 500 to 600 nm, is $500<\lambda_{-R}<560$ and the difference between the center-of-gravity wavelength ($\lambda_G$) of the wavelength distribution of interimage effect of the green-sensitive layer and ($\lambda_{-R}$) is $\lambda_G-\lambda_{-R}\geqq 10$ nm, and preferably $\lambda_G-\lambda_{-R}\geqq 15$ nm; the center-of-gravity wavelength ($\lambda_{-G1}$) of the wavelength distribution of magnitude in interimage effect which the green-sensitive layer receives from other layers within the range of 400 to 500 nm, is $400<\lambda_{-G1}<460$ and the difference between the center-of-gravity wavelength ($\lambda_B$) of the wavelength distribution of interimage effect of the blue-sensitive layer and $\lambda_{-G1}$ is $\lambda_B-\lambda_{-G1}\geqq 10$ nm, and preferably $\lambda_B-\lambda_{-G1}\geqq 15$ nm; and the center-of-gravity wavelength ($\lambda_{-G2}$) of the wavelength distribution of magnitude in interimage effect which the green-sensitive layer receives from other layers within the range of 600 to 700 nm, is $620<\lambda_{-G2}<700$ and the difference between the center-of-gravity wavelength ($\lambda_R$) of the wavelength distribution of interimage effect of the red-sensitive layer and $\lambda_{-G2}$ is $\lambda_R-\lambda_{-G2}\leqq -10$ nm, preferably $\lambda_B-\lambda_{-G2}\leqq -15$ nm, more preferably $\lambda_B-\lambda_{-G2}\leqq -20$ nm, and still more preferably $\lambda_B-\lambda_{-G2}\leqq -30$ nm.

Enhanced color reproduction and improved fitness to different light sources can be achieved by adjusting the spectral sensitivity distribution and interimage effect of the color photographic material, as described above.

The silver halide emulsion used in this invention is preferably comprised of tabular grains having an aspect ratio of 8 or more, accounting for at least 50% of the total grain projected area, and more preferably tabular grains having an aspect ratio of 15 or more, accounting for at least 50% of the total grain projected area. In this invention, the aspect ratio refers to a ratio of grain diameter to grain thickness. The grain diameter refers to a diameter of a circle having an area identical to that of the grain, so-called circular equivalent diameter. The aspect ratio refers to a ratio of grain diameter to grain thickness.

Silver halide emulsions usable in the invention include those described in Research Disclosure No.308119 (hereinafter, simply denoted as RD308119).

| Item | RD 308119 |
|---|---|
| Iodide | 993, I-A |
| Preparing method | 993, I-A; 994, I-E |
| Crystal habit (regular crystal) | 993, I-A |
| Crystal habit (twinned crystal) | 993, I-A |
| Epitaxial | 993, I-A |
| Halide composition (uniform) | 993, I-B |
| Halide composition (non-uniform) | 993, I-B |
| Halide conversion | 994, I-C |
| Halide substitution | 994, I-C |
| Metal occlusion | 994, I-D |
| Grain size distribution | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive) | 995, I-H |
| Emulsion blending | 995, I-J |
| Desalting | 995, II-A |

The silver halide emulsion according to the invention is subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E, J | 23–24 | 648–9 |
| Antifoggant | 998, VI | 24–25 | 649 |
| Stabilizer | 998, VI | 24–25 | 649 |

Photographic additives usable in the invention are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Whitening Agent | 998, V | 24 | |
| U.V. Absorbent | 1003, VIII-I, XIII-C | 25–26 | |
| Light Absorbent | 1003, VIII | 25–26 | |
| Light-Scattering Agent | 1003, VIII | | |
| Filter Dye | 1003, VIII | 25–26 | |
| Binder | 1003, IX | 26 | 651 |
| Antistatic Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant, Coating aid | 1005, XI | 26–27 | 650 |
| Matting Agent | 1007, XVI | | |
| Developing Agent (included in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | 25, VII-C~G |
| Magenta coupler | 1001, VII-D | 25, VII-C~G |
| Cyan coupler | 1001, VII-D | 25, VII-C~G |
| Colored coupler | 1002, VII-G | 25, VII-G |
| DIR coupler | 1001, VII-F | 25, VII-F |
| BAR coupler | 1002, VII-F | |
| PUG releasing coupler | 1001, VII-F | |
| Alkali-soluble coupler | 1001, VII-E | |

Additives used in the invention can be added by dispersing methods described in RD 308119 XIV. In the invention are employed supports described in RD 17643, page 28; RD 18716, page 647–648; and RD 308119 XIX. In the photographic material according to the invention, there can be provided auxiliary layers such as a filter layer and interlayer, as described in RD 308119 VII-K, and arranged a variety of layer orders such as normal layer order, reverse layer order and unit layer arrangement.

Silver halide photographic light sensitive materials used in the invention can be processed by use of commonly known developing agents described in T. H. James, The Theory of the Photographic Process, Fourth edition, page 291 to 334; and Journal of American Chemical Society, 73, 3100 (1951), and according the conventional method described in RD17643, pages 28–29, RD18716, page 615 and RD308119, XIX.

EXAMPLES

Example 1

The following layers containing composition as shown below were formed on a subbed triacetyl cellulose film support to prepare a multi-layered color photographic material Samples 101. The addition amount of each compound was represented in term of g/m$^2$, provided that the amount of silver halide or colloidal silver was converted to the silver amount and the amount of a sensitizing dye (denoted as "SD") was represented in mol/Ag mol.

| 1st Layer: Anti-Halation Layer | |
|---|---|
| Black colloidal silver | 0.16 |
| UV-1 | 0.3 |
| CM-1 | 0.123 |
| CC-1 | 0.044 |
| OIL-1 | 0.167 |
| AS-1 | 0.16 |
| Gelatin | 1.60 |

| 2nd Layer: Low-speed Red-Sensitive Layer | |
|---|---|
| Silver iodobromide emulsion a | 0.20 |
| Silver iodobromide emulsion b | 0.29 |
| SD-1 | $1.0 \times 10^{-5}$ |
| SD-2 | $1.2 \times 10^{-4}$ |
| SD-3 | $2.4 \times 10^{-4}$ |
| SD-4 | $2.4 \times 10^{-6}$ |
| C-1 | 0.32 |
| CC-1 | 0.018 |
| OIL-2 | 0.28 |
| AS-2 | 0.002 |
| Gelatin | 0.73 |

| 3rd Layer: Medium-speed Red-sensitive Layer | |
|---|---|
| Silver iodobromide emulsion c | 0.10 |
| Silver iodobromide emulsion d | 0.86 |
| SD-1 | $1.5 \times 10^{-5}$ |
| SD-2 | $2.3 \times 10^{-4}$ |
| SD-3 | $4.5 \times 10^{-4}$ |
| C-2 | 0.52 |
| CC-1 | 0.055 |
| DI-1 | 0.037 |
| OIL-2 | 0.46 |
| AS-2 | 0.004 |
| Gelatin | 1.30 |

| 45th Layer: High-speed Red-Sensitive Layer | |
|---|---|
| Silver iodobromide emulsion c | 0.13 |
| Silver iodobromide emulsion d | 1.18 |
| SD-1 | $1.0 \times 10^{-5}$ |
| SD-2 | $1.5 \times 10^{-4}$ |
| SD-3 | $3.0 \times 10^{-4}$ |
| C-2 | 0.047 |
| C-3 | 0.09 |
| DI-1 | 0.048 |
| OIL-2 | 0.27 |
| AS-2 | 0.006 |
| Gelatin | 1.28 |

| 5th Layer: Intermediate Layer | |
|---|---|
| OIL-1 | 0.29 |
| AS-1 | 0.23 |
| Gelatin | 1.00 |

| 6th Layer: Low-speed Green-Sensitive Layer | |
|---|---|
| Silver iodobromide emulsion a | 0.19 |
| Silver iodobromide emulsion b | 0.062 |
| SD-4 | $3.6 \times 10^{-5}$ |
| SD-5 | $3.6 \times 10^{-4}$ |
| M-1 | 0.18 |
| CM-1 | 0.033 |
| DI-2 | 0.048 |
| OIL-1 | 0.22 |
| AS-2 | 0.002 |
| AS-3 | 0.05 |
| Gelatin | 0.61 |

| 7th Layer: Medium-speed Green-Sensitive Layer | |
|---|---|
| Silver iodobromide emulsion e | 0.54 |
| Silver iodobromide emulsion f | 0.54 |
| SD-6 | $3.7 \times 10^{-4}$ |
| SD-7 | $7.4 \times 10^{-5}$ |
| SD-8 | $5.0 \times 10^{-5}$ |

-continued

| | |
|---|---|
| M-1 | 0.43 |
| CM-1 | 0.024 |
| CM-2 | 0.029 |
| DI-2 | 0.012 |
| DI-3 | 0.005 |
| OIL-1 | 0.73 |
| AS-3 | 0.035 |
| AS-2 | 0.003 |
| Gelatin | 1.80 |

| 8th Layer: High-speed Green-Sensitive Layer | |
|---|---|
| Sensitized emulsion f | 1.19 |
| SD-6 | $4.0 \times 10^{-4}$ |
| SD-7 | $8.0 \times 10^{-5}$ |
| SD-8 | $5.0 \times 10^{-5}$ |
| M-1 | 0.065 |
| CM-2 | 0.026 |
| CM-1 | 0.022 |
| DI-3 | 0.003 |
| OIL-1 | 0.19 |
| AS-3 | 0.017 |
| AS-2 | 0.014 |
| Gelatin | 1.23 |

| 9th Layer: Yellow Filter Layer | |
|---|---|
| Yellow colloidal silver | 0.05 |
| OIL-1 | 0.18 |
| AS-1 | 0.16 |
| Gelatin | 1.00 |

| 10th Layer: Low-speed Blue-sensitive Layer | |
|---|---|
| Silver iodobromide emulsion b | 0.22 |
| Silver iodobromide emulsion a | 0.08 |
| Silver iodobromide emulsion h | 0.09 |
| SD-9 | $6.5 \times 10^{-4}$ |
| SD-10 | $2.5 \times 10^{-4}$ |
| Y-1 | 0.77 |
| DI-4 | 0.051 |
| OIL-1 | 0.31 |
| AS-2 | 0.002 |
| Gelatin | 1.29 |

| 11th Layer: High-sped Blue-sensitive Layer | |
|---|---|
| Silver iodobromide emulsion h | 0.41 |
| Silver iodobromide emulsion i | 0.61 |
| SD-9 | $4.4 \times 10^{-4}$ |
| SD-10 | $1.5 \times 10^{-4}$ |
| Y-1 | 0.23 |
| OIL-1 | 0.10 |
| AS-2 | 0.004 |
| Gelatin | 1.20 |

-continued

| 12th Layer: First Protective Layer | |
|---|---|
| Silver iodobromide emulsion j | 0.30 |
| UV-1 | 0.055 |
| UV-2 | 0.11 |
| OIL-2 | 0.30 |
| Gelatin | 1.32 |

| 13th Layer: Second protective Layer | |
|---|---|
| PM-1 | 0.15 |
| PM-2 | 0.04 |
| WAX-1 | 0.02 |
| D-1 | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.30 | 2.0 | 1.0 |
| b | 0.40 | 4.0 | 1.4 |
| c | 0.60 | 5.0 | 5.1 |
| d | 0.74 | 6.0 | 7.0 |
| e | 0.60 | 4.0 | 4.1 |
| f | 0.65 | 5.7 | 7.5 |
| h | 0.65 | 4.0 | 4.4 |
| i | 1.00 | 5.0 | 7.0 |
| j | 0.05 | 2.0 | 1.0 |

After adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AP-3, AF-4 and AF-5; hardener H-1 and H-2; and antiseptic Ase-1.

The structure of the compounds used in the sample are shown below.

C-1

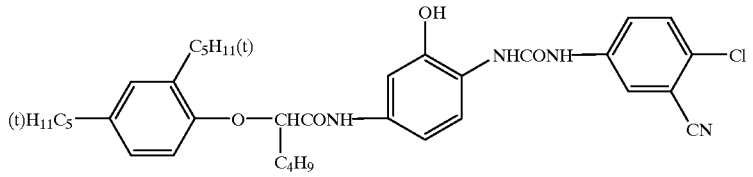

C-2

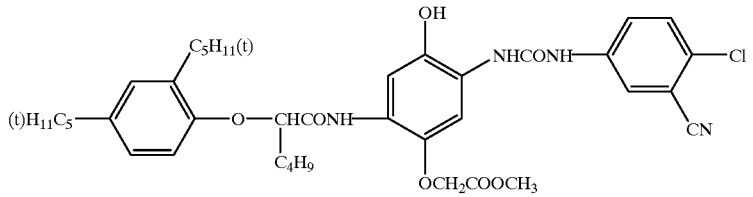

-continued
C-3
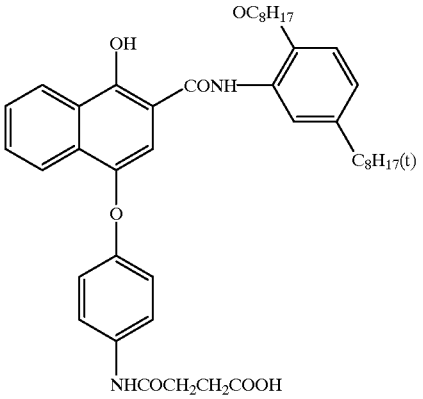
M-1
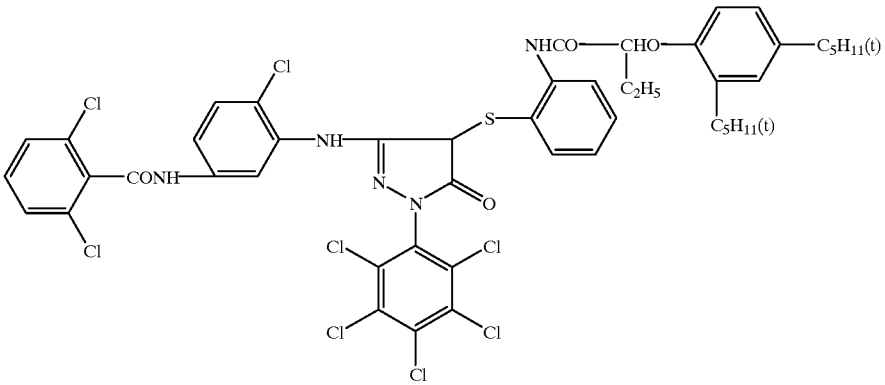
Y-1
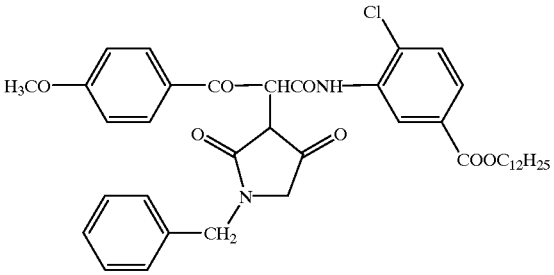
CC-1
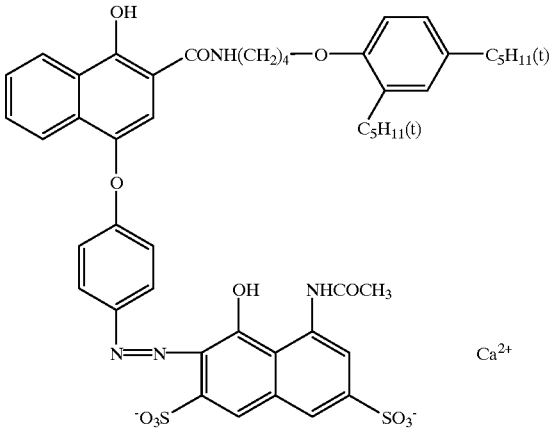
CM-1
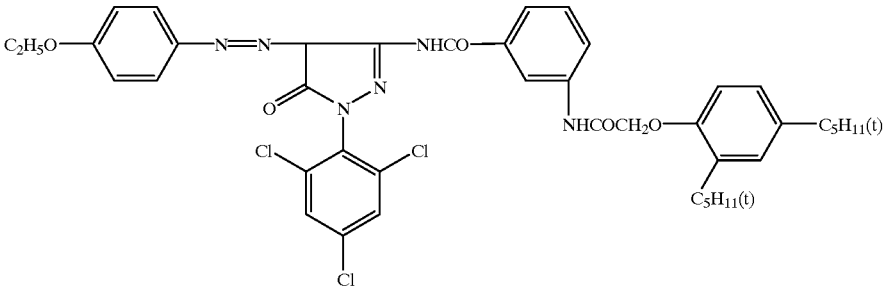

-continued
CM-2
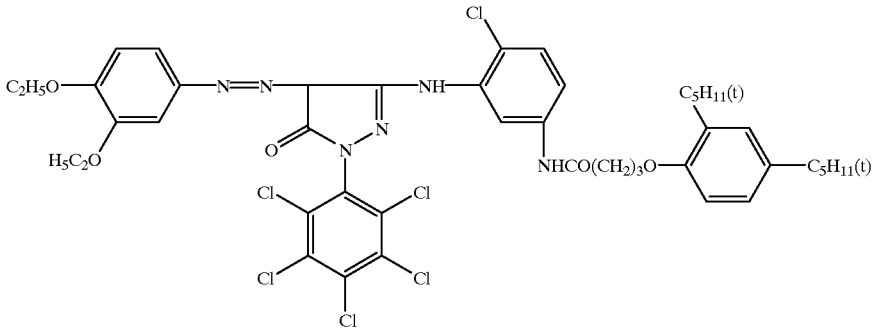
DI-1
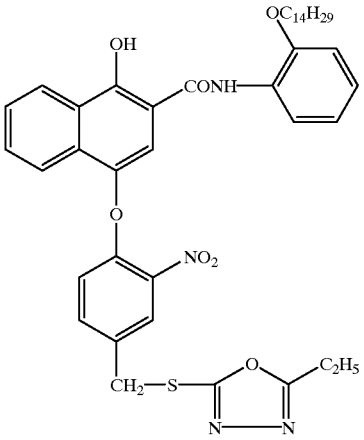
DI-2
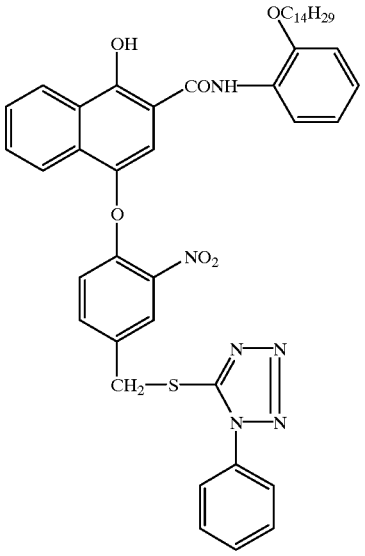
DI-3
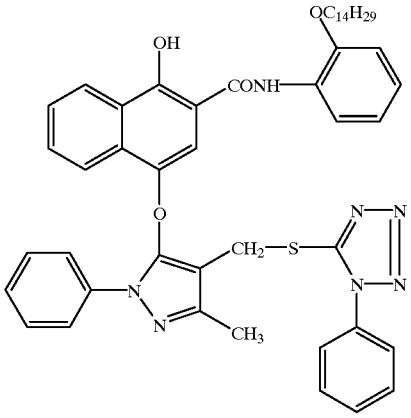
DI-4
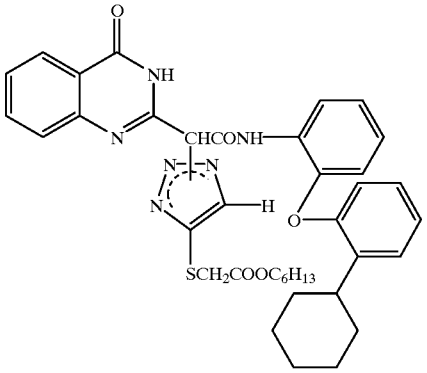
AS-1
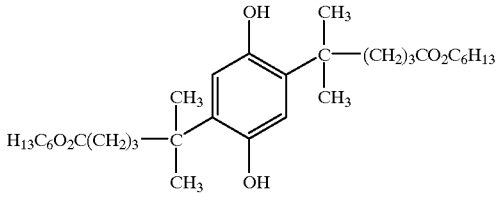
AS-2
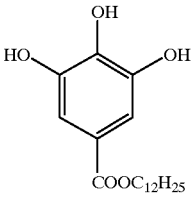

-continued
AS-3
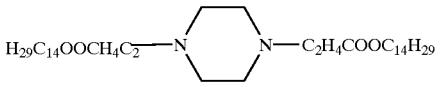
SD-1
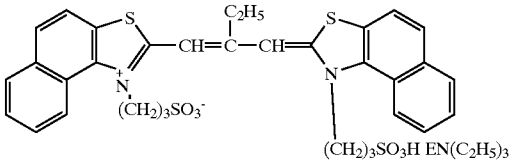
SD-2
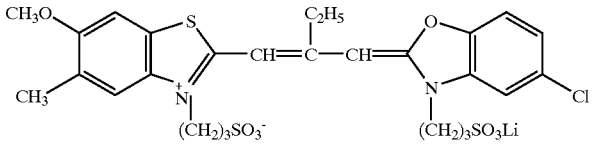
SD-3
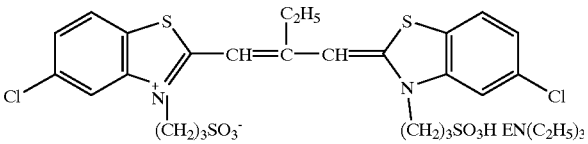
SD-4
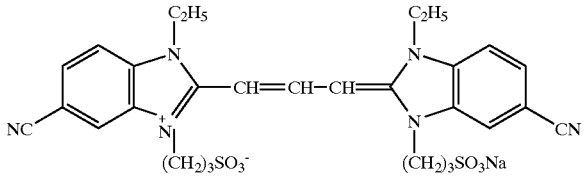
SD-5
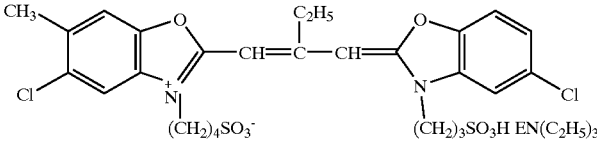
SD-6
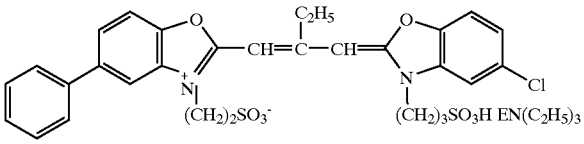
SD-7
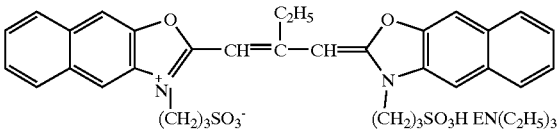
SD-8
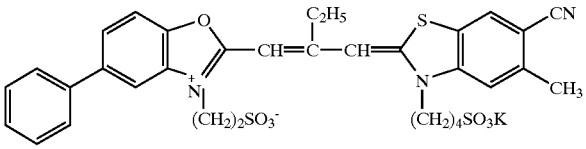
SD-9
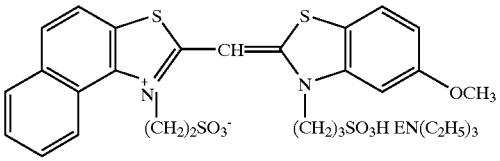
SD-10
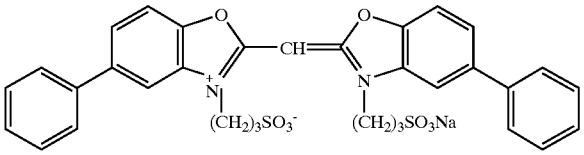
ST-1
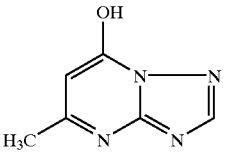
ST-2
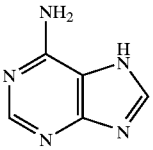
AF-1, 2
AF-1 Mw ≈ 10,000
AF-2 Mw ≈ 100,000
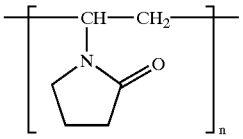
n: Degree of polymerization
AF-3
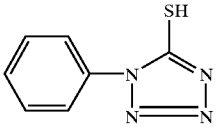
AF-4
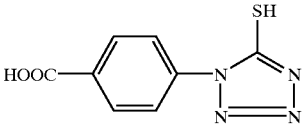

-continued
AF-5
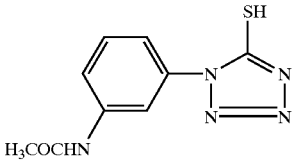
SU-1
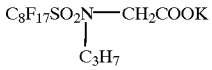
SU-2
$C_8F_{17}SO_2NH(CH_2)_3N^+(CH_3)_3Br^-$
SU-3
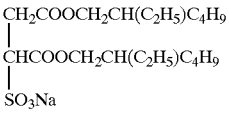
SU-4
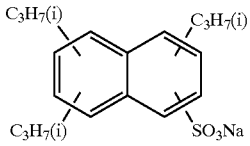
WAX-1
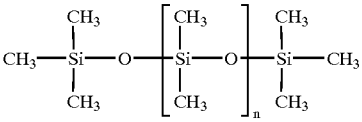
Mw ≈ 3,000
D-1
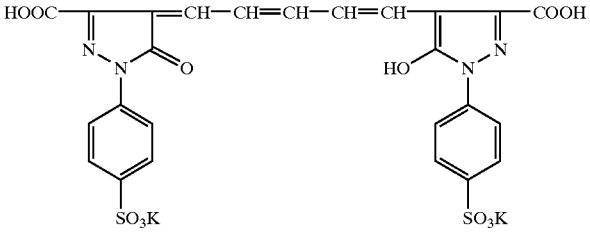
PM-1
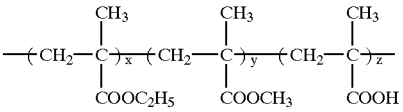
x:y:z = 3:3:4
PM-2
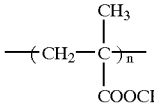
n: Degree of polymerization
OIL-1
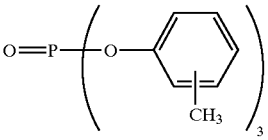
OIL-2
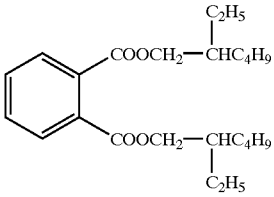
UV-1
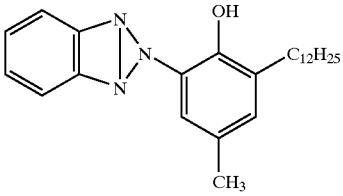
UV-2
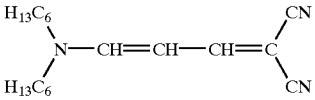
V-1
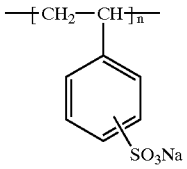
n: Degree of polymerization
Ase-1 (mixture)
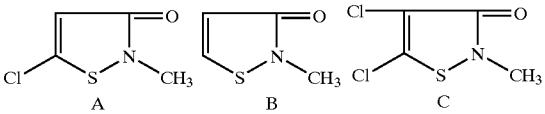
A B C
(A:B:C = 50:46:4, molar ratio)
H-1
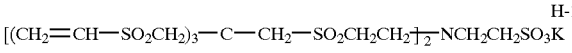

-continued

H-2

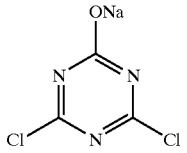

Samples 102 through 116 were prepared similarly to Sample 101, as follows.

Thus, Sample 102 was prepared similarly to Sample 101, provided that sensitizing dye SD-7 used in the 8th layer was replaced by exemplified sensitizing dye S-1–6.

Sample 103 was prepared similarly to Sample 101, provided that sensitizing dye SD-6 used in the 8th layer was replaced by exemplified sensitizing dye S-2–8.

Sample 104 was prepared similarly to Sample 101, provided that sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 105 was prepared similarly to Sample 101, provided that the amount of sensitizing dye SD-1 used in the 4th layer was varied to $5\times10^{-5}$.

Sample 106 was prepared similarly to Sample 101, provided that the amount of sensitizing dye SD-1 used in the 4th layer was varied to $5\times10^{-5}$ and SD-1 was added to silver iodobromide emulsions c and d, prior to SD-2 and SD-3.

Sample 107 was prepared similarly to Sample 101, provided that sensitizing dye SD-2 used in the 4th layer was added to silver iodobromide emulsions c and d, prior to SD-1 and SD-3.

Sample 109 was prepared similarly to Sample 101, provided that the amount of sensitizing dye SD-1 used in the 4th layer was changed to $5\times10^{-5}$, SD-1 was added to silver iodobromide emulsions c and d, prior to SD-2 and SD-3; and sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 110 was prepared similarly to Sample 101, provided that sensitizing dye SD-2 used in the 4th layer was added to silver iodobromide emulsions c and d, prior to SD-1 and SD-3; and sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 111 was prepared similarly to Sample 101, provided that sensitizing dye SD-10 used in the 11th layer was added to silver iodobromide emulsions h and i, prior to SD-9.

Sample 112 was prepared similarly to Sample 101, provided that sensitizing dye SD-10 used in the 11th layer was added to silver iodobromide emulsions h and i, prior to SD-9; and sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 113 was prepared similarly to Sample 101, provided that the amount of sensitizing dye SD-1 used in the 4th layer was varied to $5\times10^{-5}$, SD-1 was added to silver iodobromide emulsions c and d, prior to SD-2 and SD-3; sensitizing dye SD-10 used in the 11th layer was added to silver iodobromide emulsions h and i, prior to SD-9; and sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 114 was prepared similarly to Sample 101, provided that sensitizing dye SD-2 used in the 4th layer was added to silver iodobromide emulsions c and d, prior to SD-1 and SD-3; sensitizing dye SD-10 used in the 11th layer was added to silver iodobromide emulsions h and i, prior to SD-9; and sensitizing dyes used in the 8th layer were varied as follow:

| | |
|---|---|
| SD-6 | $3.0 \times 10^{-4}$ |
| S-1-7 | $8.0 \times 10^{-5}$ |
| S-2-8 | $1.5 \times 10^{-4}$. |

Sample 115 was prepared similarly to Sample 114, provided that silver iodobromide emulsion f used in the $8^{th}$ layer was varied to an emulsion comprised of tabular grains having an aspect ratio of 15.

Sample 116 was prepared similarly to Sample 101, provided that sensitizing dye SD-2 used in the 4th layer was added to silver iodobromide emulsions c and d, prior to SD-1 and SD-3; sensitizing dye SD-10 used in the 11th layer was added to silver iodobromide emulsions h and i, prior to SD-9; and sensitizing dyes used in the 4th, 6th, 8th and 10th layers were varied as follows:

| 4th layer | |
|---|---|
| SD-1 | $4.0 \times 10^{-5}$ |
| SD-2 | $1.2 \times 10^{-4}$ |
| SD-3 | $3.3 \times 10^{-4}$ |

-continued

| | |
|---|---|
| 6th layer | |
| SD-4 | $3.6 \times 10^{-5}$ |
| SD-5 | $1.6 \times 10^{-4}$ |
| SD-11 | $2.0 \times 10^{-4}$ |
| 8th layer | |
| SD-6 | $3.0 \times 10^{-4}$ |
| S-1-7 | $8.0 \times 10^{-5}$ |
| S-2-8 | $1.5 \times 10^{-4}$. |
| 10th layer | |
| SD-12 | $4.5 \times 10^{-4}$ |
| SD-10 | $4.5 \times 10^{-4}$ |

In the spectral sensitivity distribution of each sample, the sensitivity maximum wavelength of each layer is shown in Table 1. The center-of-gravity wavelength in the spectral sensitivity distribution of Sample No. 116 was determined, as shown below, provided that the value of "b" in FIG. 1 is 0.3. The center-of-gravity wavelength, $\lambda_{-i}$ (i=R, G, B) of the spectral sensitivity distribution of the interimage effect given by other light sensitive layer(s) is also shown below.

| | |
|---|---|
| $\lambda_R$ | 640 nm |
| $\lambda_G$ | 550 nm |
| $\lambda_B$ | 450 nm |
| $\lambda_{-R}$ | 526 nm |
| $\lambda_{-G1}$ | 425 nm |
| $\lambda_{-G2}$ | 656 nm |
| $\lambda_G-\lambda_{-R}$ | 24 nm |
| $\lambda_B-\lambda_{-G1}$ | 25 nm |
| $\lambda_R-\lambda_{-G2}$ | 16 nm |

Samples were each tested in the following manner. Results thereof are shown in Table 1.

Test 1

Samples were each exposed to white light through an optical wedge and processed in accordance with the process described in JP-A 12-63690 in col. [0263] through [0270] to determine sensitivity of each light sensitive layer. Sensitivity was represented by a relative value, based on the sensitivity of Sample No. 101 being 100.

Test 2

Evaluation of Color Reproduction

Samples were each cut to a standard 135 film size, put into a film cartridge and then loaded into a camera (Konica HEXAR, available from Konica Corp.). Using this camera, portraits of a woman having a Macbeth chart were photographed in a park under a clear sky. Exposed films were subjected to color processing similarly to Test 1 and dried to obtained color negative films. The thus obtained color negative films were printed on color print paper (Konica Color Paper QA Type A7) using a color printer, which was subjected to processing (Konica CPK-2–21) to obtain color prints of a 2L-size. Printing conditions were adjusted so that the color patch of neutral No. 5 of Macbeth chart was reproduced at the original color.

The obtained color prints were measured using a color-difference-meter (CR-200, available from MINOLTA Co., Ltd.), with respect to all colors of the color checker (Macbeth chart) and the sum of differences in hue angle between the reproduction points and the original of 18 chromatic colors other than neutral gray was determined. The Macbeth chart is Color Rendition Chart (available from U.S. Macbeth Corp.) and the difference in hue angle (or hue angle difference, Δhab) is defined as below:

Hue angle (denoted as "hab"): hab=arctan (b*/a*)

Hue angle difference (Δhab): Δhab=|hab'−hab| where hab represents the hue angle of the Macbeth chart (original) and hab' represents the hue angle of the Macbeth chart reproduced on a color print. CIE 1976 L*a*b* color space is detailed, for example, in "SHINPEN SHIKISAIKAGAKU HANDBOOK, 2nd ed." (Color Science Handbook, 2nd ed., 1998, page 87–130, edited by NIHON SHIKISAIGAKKAI), Chapter 4, Color System.

Test 3

Evaluation of Color Reproduction Under Fluorescent Lamp

Samples were each cut to the standard 135 film size and using a camera (HEXAR, available from Konica Corp.), a portrait and an 18% reflection gray cut were photographed outdoors under bright sun light. The same scenes were photographed indoors under fluorescent lamps. The photographed samples were subjected to the color processing described above. The thus obtained color negative films were printed on color print paper (Konica Color Paper QA Type A7) using a color printer (NPS-1771, available from Konic a Corp.), which was subjected to processing to obtain 2L-size color prints. Printing conditions were adjusted so that scenes photographed under sun light were naturally finished and the scenes photographed under fluorescent lamps were printed in the same printing conditions. Finished prints were evaluated with respect to color tone of human faces photographed indoors under fluorescent lamps, based on the following criteria:

A: finished prints were close to those photographed under sun light,

B: finished prints were somewhat close to those of photographed under sun light, C: slightly greenish prints, D: greenish prints at an unacceptable level.

TABLE 1

| Sample | Sensitivity Maximum Wavelength (nm)*1 | | | Test 1 Sensitivity | | | Test 2 Color Reproduction*2 | Test 3 Print Evaluation | |
|---|---|---|---|---|---|---|---|---|---|
| No. | R*3 | G*3 | B*3 | R | G | B | | | Remark |
| 101 | 645 | 555 | 420 | 100 | 100 | 100 | 146 | D | Comp. |
| 102 | 645 | 545, 560 | 420 | 100 | 112 | 100 | 143 | B | Inv. |

TABLE 1-continued

| Sample No. | Sensitivity Maximum Wavelength (nm)*1 R*3 | G*3 | B*3 | Test 1 Sensitivity R | G | B | Test 2 Color Reproduction*2 | Test 3 Print Evaluation | Remark |
|---|---|---|---|---|---|---|---|---|---|
| 103 | 645 | 535, 560 | 420 | 100 | 107 | 100 | 137 | B | Inv. |
| 104 | 645 | 555, 535 | 420 | 100 | 126 | 100 | 133 | B | Inv. |
| 105 | 655 | 555 | 420 | 126 | 100 | 100 | 165 | D | Comp. |
| 106 | 630, 675 | 555 | 420 | 126 | 100 | 100 | 143 | C | Comp. |
| 107 | 640, 615 | 555 | 420 | 126 | 100 | 100 | 138 | C | Comp. |
| 109 | 630, 675 | 555, 535 | 420 | 126 | 126 | 100 | 127 | B | Inv. |
| 110 | 640, 615 | 555, 535 | 420 | 126 | 126 | 100 | 123 | B | Inv. |
| 111 | 645 | 555 | 470, 420 | 100 | 100 | 112 | 153 | D | Comp. |
| 112 | 645 | 555, 535 | 470, 420 | 100 | 126 | 112 | 131 | B | Inv. |
| 113 | 630, 675 | 555, 535 | 470, 420 | 126 | 126 | 112 | 121 | A | Inv. |
| 114 | 640, 615 | 555, 535 | 470, 420 | 126 | 126 | 112 | 116 | A | Inv. |
| 115 | 640, 615 | 555, 535 | 470, 420 | 126 | 158 | 112 | 117 | A | Inv. |
| 116 | 640, 615 | 555, 535 | 470, 420 | 126 | 158 | 112 | 106 | A | Inv. |

*1The wavelength exhibiting the largest sensitivity is shown on the left in cases where a light sensitive layer exhibits at least two sensitivity maxima.
*2Color reproduction of the Macbeth chart
*3R (Red-sensitive layer), G (Green-sensitive layer), B (Blue-sensitive layer).

As can be seen from Table 1, it was proved that samples according to this invention exhibited enhanced sensitivity and superior color reproduction, leading to superior printing performance of photography under fluorescent lamps.

What is claimed is:

1. A silver halide color photographic light sensitive material comprising a support having on one side of the support at least two red-sensitive layers, at least two green-sensitive layers, at least two blue-sensitive layer and a light-insensitive layer, wherein at least one of the green-sensitive layers contains a green-sensitive silver halide emulsion exhibiting a sensitivity maximum at a wavelength of 525 to 540 nm and a sensitivity maximum at a wavelength of 550 to 565 nm.

2. The silver halide color photographic material of claim 1, wherein the sensitivity maximum at a wavelength of 525 to 540 nm exhibits the largest value of sensitivity.

3. The silver halide color photographic material of claim 1, wherein the sensitivity maximum at a wavelength of 550 to 565 nm exhibits the largest value of sensitivity.

4. The silver halide color photographic material of claim 1, wherein the green sensitive silver halide emulsion contains a sensitizing dye (1) and a sensitizing dye (2), the sensitizing dye (1) and sensitizing dye (2) exhibiting a sensitivity maximum at a wavelength of 525 to 550 nm and of 560 to 580 nm, respectively, when forming a J-aggregate.

5. The silver halide color photographic material of claim 1, wherein the green-sensitive silver halide emulsion contains a compound represented by formula (S-1) or (S-2):

formula (S-1)

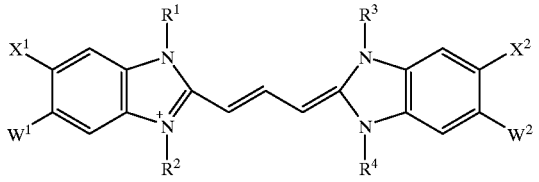

$(M^1)_{m1}$ wherein $R^1$ through $R^4$ are each an aliphatic group; $X^1$ and $X^2$ are each a hydrogen atom or a halogen atom; $W^1$ and $W^2$ are each a substituent group containing an oxygen atom; $M^1$ is an ion necessary to counterbalance intramolecular charge; and $m^1$ is a number of the ion necessary to counterbalance the intramolecular charge;

formula (S-2)

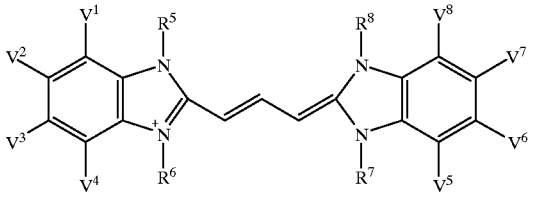

$(M^2)_{m2}$ wherein $R^5$ through $R^8$ are each an aliphatic group; $V^1$ through $V^8$ are each a hydrogen atom, a halogen atom or a substituent group, provided that $V^2$ and $V^3$ may combine with each other to form a ring; $M^2$ is an ion necessary to counterbalance intramolecular charge; and $m^2$ is a number of the ion necessary to counterbalance the intramolecular charge.

6. The silver halide color photographic material of claim 1, wherein at least one of the red-sensitive layers contains a red-sensitive silver halide emulsion exhibiting at least two sensitivity maxima at a wavelength of 500 nm or more, one of the two sensitivity maxima exhibiting the largest value of sensitivity at a wavelength (λmax) of 590 to 630 nm, and the other sensitivity maximum being at a wavelength of more than λmax and not more than 700 nm.

7. The silver halide color photographic material of claim 1, wherein at least one of the red-sensitive layers contains a red-sensitive silver halide emulsion exhibiting at least two sensitivity maxima at a wavelength of 500 nm or more, one of the two sensitivity maxima exhibiting the largest value of sensitivity at a wavelength (λmax) of 615 to 640 nm, and the other sensitivity maximum being at a wavelength of not less than 590 nm and less than λmax.

8. The silver halide color photographic material of claim 1, wherein at least one of the blue-sensitive layers contains a blue-sensitive silver halide emulsion exhibiting at least two sensitivity maxima, one of the two sensitivity maxima exhibiting the largest value of sensitivity at a wavelength (λmax) of 450 to 480 nm, and the other sensitivity maximum being at a wavelength of not less than 410 nm and less than λmax.

9. The silver halide color photographic material of claim 1, wherein at least one of the red-sensitive layers exhibits a center-of-gravity wavelength ($\lambda_R$) of a spectral sensitivity distribution at 600 to 680 nm, at least one of the green-sensitive layers exhibiting a center-of-gravity wavelength ($\lambda_G$) of a spectral sensitivity distribution at 500 to 580 nm, and at least one of the blue-sensitive layers exhibiting a center-of-gravity wavelength ($\lambda_B$) of a spectral sensitivity distribution at 400 to 480 nm; the red-sensitive exhibiting a center-of-gravity wavelength of a spectral sensitivity distribution at a wavelength ($\lambda_{-R}$) of 500 to 560 nm with respect to the magnitude of an interimage effect given by another light sensitive layer within the region of 500 to 600 nm and meeting the requirement of $\lambda_G-\lambda_{-R}\geqq 10$ nm; the green-sensitive exhibiting a center-of-gravity wavelength of a spectral sensitivity distribution at a wavelength ($\lambda_{-G1}$) of 400 to 460 nm with respect to the magnitude of an interimage effect given by another light sensitive layer within the region of 400 to 500 nm and meeting the requirement of $\lambda_B-\lambda_{-G1}\geqq 10$ nm; and the green-sensitive exhibiting a center-of-gravity wavelength of a spectral sensitivity distribution at a wavelength ($\lambda_{-G2}$) of 620 to 700 nm with respect to the magnitude of an interimage effect given by another light sensitive layer within the region of 600 to 700 nm and meeting the requirement of $\lambda_R-\lambda_{-G2}\leqq -10$ nm.

10. The silver halide color photographic material of claim 1, wherein the green-sensitive silver halide emulsion contains tabular silver halide grains exhibiting an aspect ratio of 8 or more.

11. The silver halide color photographic material of claim 1, wherein the green-sensitive silver halide emulsion exhibits a sensitivity maximum at a wavelength of 525 to 535 nm and a sensitivity maximum at a wavelength of 555 to 565 nm.

12. The silver halide color photographic material of claim 6, wherein the red-sensitive silver halide emulsion exhibits at least two sensitivity maxima at a wavelength of 500 nm or more, one of the two sensitivity maxima exhibiting the largest value of sensitivity at a wavelength (λmax) of 600 to 630 nm, and the other sensitivity maximum being at a wavelength of more than λmax and not more than 675 nm.

13. The silver halide color photographic material of claim 7, wherein the red-sensitive silver halide emulsion exhibiting at least two sensitivity maxima at a wavelength of 500 nm or more, one of the two sensitivity maxima exhibiting the largest value of sensitivity at a wavelength (λmax) of 625 to 640 nm, and the other sensitivity maximum being at a wavelength of not less than 600 nm and less than λmax.

14. The silver halide color photographic material of claim 8, wherein the blue-sensitive silver halide emulsion exhibits at least two sensitivity maxima, one of the two sensitivity maxima exhibiting the largest value of sensitivity at a wavelength (λmax) of 460 to 475 nm, and the other sensitivity maximum being at a wavelength of not less than 415 nm and less than λmax.

* * * * *